US005769663A

United States Patent [19]

Kodama

[11] Patent Number: 5,769,663

[45] Date of Patent: Jun. 23, 1998

[54] CONNECTOR HOUSING

[75] Inventor: Shinji Kodama, Shizuoka-ken, Japan

[73] Assignee: Yazaki Corporation, Tokyo, Japan

[21] Appl. No.: 569,427

[22] Filed: Dec. 8, 1995

[30] Foreign Application Priority Data

Dec. 9, 1994 [JP] Japan ..... 6-306396

[51] Int. Cl.[6] ..... H01R 13/40

[52] U.S. Cl. ..... 439/595

[58] Field of Search ..... 439/595, 752

[56] References Cited

U.S. PATENT DOCUMENTS 5,057,040 10/1991 Kodama et al. ..... 439/595

FOREIGN PATENT DOCUMENTS

UM 56-4177 1/1981 Japan .

*Primary Examiner*—Gary F. Paumen
*Assistant Examiner*—Christopher Goins
*Attorney, Agent, or Firm*—Wigman, Cohen, Leitner & Myers, P.C.

[57] ABSTRACT

A connector housing for accommodating terminals therein includes a housing body having a plurality of cavities, a plurality of flexible lances which are cngageable with the terminals, and a plurality of cavity orifices for allowing the lances to be displaced in a disengagement direction with the terminals. The lance is provided with slanted surfaces for stopping an excessive displacement of the lances. When the terminals are inserted into the cavities, the lances are displaced in the disengagement direction thereby allowing the terminals to enter into the cavities. In the case of withdrawing the terminals from the connector housing, the excessive deformation of the lance can be prevented by the slanted surfaces' interference with the cavity orifice before the lances are bent forcibly, whereby the lances can return to the initial position elastically and securely after a withdrawing operation of the terminals.

15 Claims, 3 Drawing Sheets

CONNECTOR HOUSING

BACKGROUND OF THE INVENTION

1. Technical Field

The present invention relates to a connector housing having terminal accommodating chambers (cavities) provided with lances for engagement with terminals.

2. Description of the Related Art

In a related art, Japanese Utility Model Publication (Kokal) No. 56-4177 discloses a connector housing in which a plurality of cavities are formed adjacent to each other vertically and horizontally, and are provided therein with flexible lances for engagement with terminals.

In the connector housing, each lance is formed so as to extend toward a front opening of each cavity. Formed at a free end of the lance are an engagement projection which is to be engaged in an engagement hole of each terminal and a concave portion which is to be engaged with a terminal removing tool used in removing the terminals from the connector housing.

In the process of inserting the terminals into the connector housing, the engagement projection of each lance is firstly bent by a tip of the individual terminal inserted. Then, with the tip's arrival at an axial end of the cavity, the lance can return to its initial position elastically so that the engagement projection is engaged in an engagement hole formed in the terminal, thereby preventing the terminal from slipping out of the connector housing.

In removing the terminals from the connector housing, the tool is firstly inserted into an inserting portion of the connector housing so as to hook a tip of the tool on the concave portion of the lance. Then, by further pushing the tool into the connector housing, the lance is forcibly deformed to the disengaging direction. By pulling the terminal backward while keeping such a condition, the terminal can be removed from the connector housing in this way. in the connector housing, owing to a provision of an orifice of run off formed in a wall of the cavity, the lance can be deformed freely to the disengaging direction. In removing the terminal, however, if the lance is excessively deformed to the disengagement direction, there will be a problem in that the lance cannot return to the initial position elastically, even after the tool is pulled off the connector housing. In such a case, it is impossible to engage the terminals in the connector housing again.

SUMMARY OF THE INVENTION

It is therefore an object of the present invention to provide a connector housing which is capable of preventing lances therein from being deformed excessively.

The object of the present invention described above can be accomplished by a connector housing for accommodating terminals therein, the connector housing comprising:

a housing body having a plurality of cavities formed adjacent to each other for accommodating the terminals therein;

a plurality of flexible lances arranged in the housing body corresponding to the cavities, respectively, each of the flexible lances being engageable with each of the terminals thereby to fix the terminal in position;

means for allowing the lances to be displaced in a disengagement direction with the terminals; the allowing means being formed in walls defining the cavities corresponding to the flexible lances, respectively; and stop means for stopping an excessive displacement of each of the lances, the stop means being arranged on each of the lances so as to interfere with the allowing means and restrict the excessive displacement of each of the lances in the disengagement direction by interfering with the allowing means.

With the arrangement mentioned above, when the terminals are inserted into the cavities, the lances are displaced in the disengagement direction, thereby to allow the terminals to enter in the cavities. Then, when an engaged portion of the terminal reaches a position of an engaging portion of the lance, the lance elastically returns to its initial position, thereby to fix the terminal.

In the case of drawing the terminals off the connector housing, a terminal removing tool is inserted to deform the lances to the disengagement direction forcibly. Then, since the excessive deformation of the lances can be prevented by the stop means' interference with the permission means before the lances are bent forcibly, the lances can return to the initial position elastically and securely after a drawing operation of the terminals.

In the present invention, preferably, the permission means comprises cavity orifices, each of which penetrates a wall defining each of the cavities, the wall being arranged opposite the lance.

Alternatively, the permission means comprises recesses, each of which is formed on a wall defining each of the cavities, the wall being arranged opposite to the disengagement direction of the lance.

In the present invention, more preferably, the stop means comprises slanted surfaces formed slanted relative to an upper surface of each of the lances, which upper surface faces the cavity orifice.

Alternatively, the stop means comprises projections formed in the vicinity of an upper surface of each of the lances, the upper surface facing each of the cavity orifices.

In both of the cases, even if it is required to excessively deform the lances to the disengagement direction, the slanted surfaces or the projections will interfere with the allowing means, thereby to restrict a further deformation of the lances. Thus, also in this case, the excessive deformation of the lances can be prevented, whereby the lances can return to the initial position elastically and securely after a drawing operation of the terminals.

In such a case, it is preferable that each of the lances be shaped so that a whole width thereof is larger than a width of each of the cavity orifices, while a width of the upper surface of each of the lances is smaller than the width of each of the cavity orifices.

More preferably, each of the lances is provided at a free end thereof with an engagement projection which is to be engaged in each of the terminals, and with a concave portion for engagement with a terminal removing tool.

DESCRIPTION OF THE PREFERRED EMBODIMENT

One embodiment of the present invention will be described with reference to the drawings.

Figure 1:
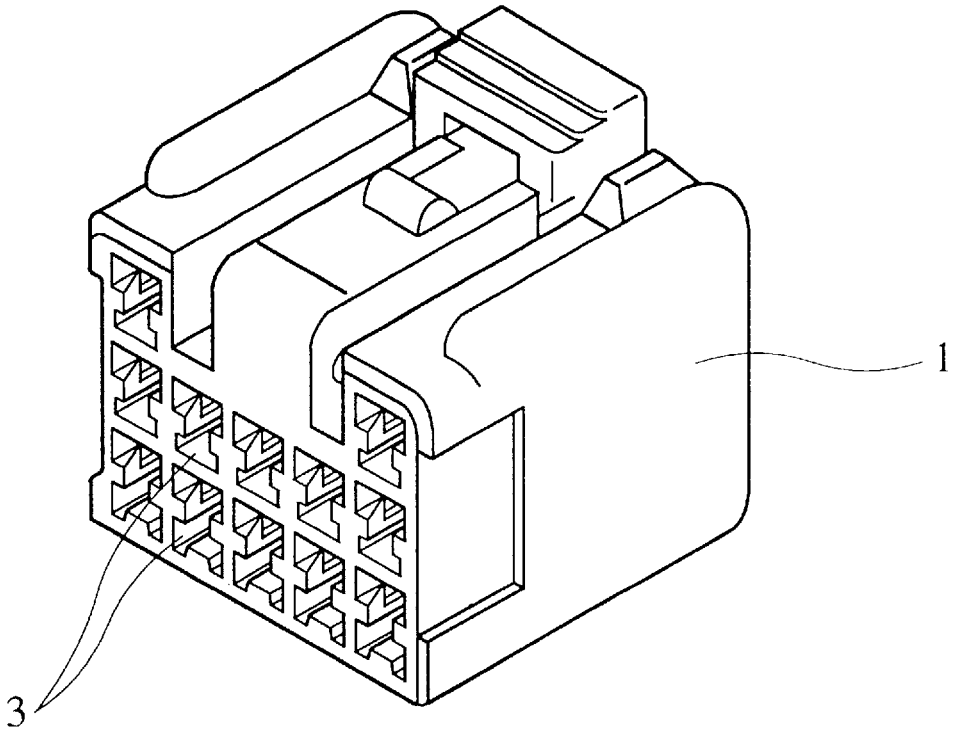
FIG. 1 is a perspective view showing a connector housing in accordance with an embodiment of the present invention.
Figure 2:
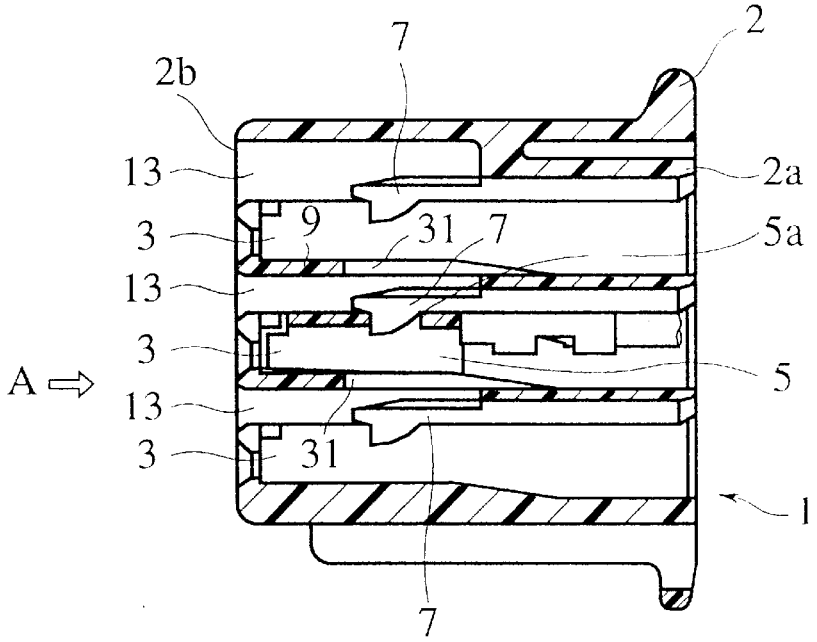
FIG. 2 is a longitudinal cross sectional view of the connector housing of FIG. 1.

FIG. 1 is a perspective view of a connector housing in accordance with an embodiment of the present invention. Additionally, FIG. 2 is a longitudinal cross sectional view of FIG. 1, and FIGS. 3A and 3B are views of a part of the connector housing viewed in the direction of arrow A of FIG. 2.

In the figures, reference numeral 1 designates a connector housing, 2 a housing body, and 3 cavities (terminal accommodating chambers ) which are formed in the housing body 2. Further, reference numeral 5 denotes a terminal, 9 a wall for defining the cavity 3, and 31 orifices which are formed in the walls 9 and which will be referred to herenafter as "cavity orifice" constituting allowing means of the invention.

Similar to the conventional connector housing, the connector housing 1 of the invention is provided with a plurality of hooking members 7 which will be referred hereinafter as "lances 7". Each of the lances 7 is provided for engaging with the individual terminal 5 inserted in the cavity 3, thereby to fix the terminal 5 in position in the housing body 2. As shown in FIG. 2, the lance 7 is formed so as to extend from a rear end 2a of the housing body 2 to the front end 2b through which a terminal removing tool 17 (FIG. 4) is inserted. Formed at a free end of the lance 7 are an engagement projection 7a which is to be engaged in an engagement hole 5a of each terminal 5 and a concave portion 7*b* which is to be engaged with the terminal removing tool 17.

Figure 3A:
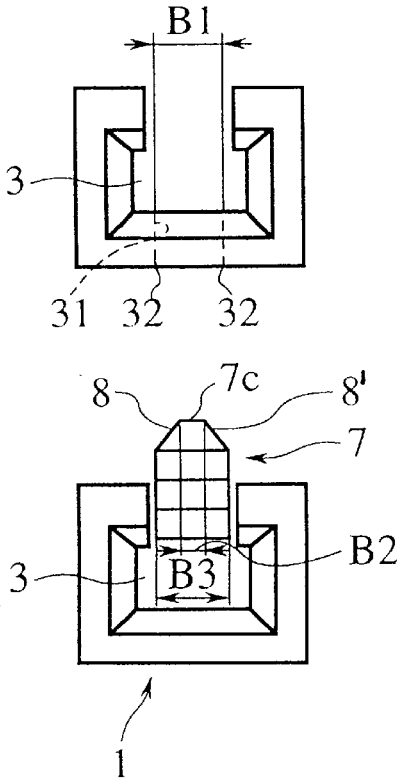
FIG. 3A is an enlarged view of a part of the connector housing of FIG. 2 , viewed along a direction of arrow A therein.
Figure 3B:
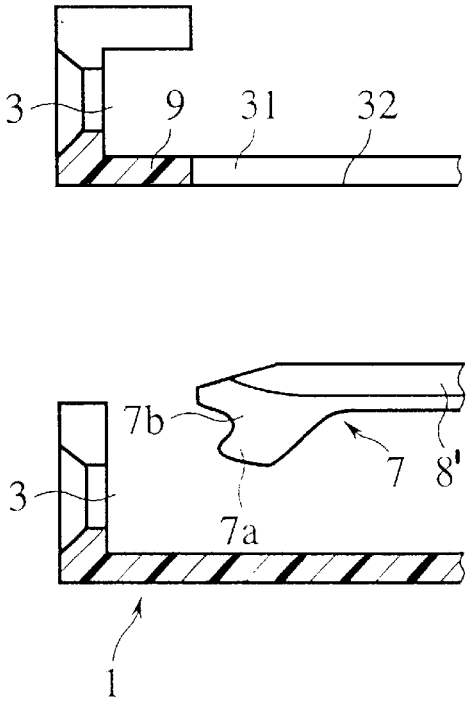
FIG. 3B is a partial cross sectional view of the connector housing of FIG. 3A.

According to the embodiment, as shown in FIG. 3A, the lance 7 is shaped so that a whole (maximum) width B3 thereof is larger than a width Bl of the cavity orifice 31, while a width B2 of an upper surface 7c of the lance 7 facing the cavity orifice 31 is smaller than the width B1 of the cavity orifice 31 (i.e., B2<B1<B3), providing symmetrical slanted surfaces 8 , 83 as stop means which terminate at both edges of the upper surface 7*c* of the lance 7. That is, an upper portion of the lance 7 facing the cavity orifice 31 is shaped so as to have a substantially wedge-shaped cross section.

With such a configuration of the lance 7, when it is bent and displaced apart from the terminal 5 (in the disengaging direction) excessively, the slanted surfaces 8,83, of the lance 7 will interfere with opposing edges 32 of the cavity orifice 31 in a direction of the width, whereby it is possible to avoid occurrence of excessive deformation of the lance 7, which may induce a permanent deformation thereto.

The connector housing 1 of the embodiment operates as follows.

When inserting the terminals 5 into the connector housing 1 from the rear end 2a, the lances 7 operate to engage with the terminals 5 in the connector housing 1.

Figure 4:
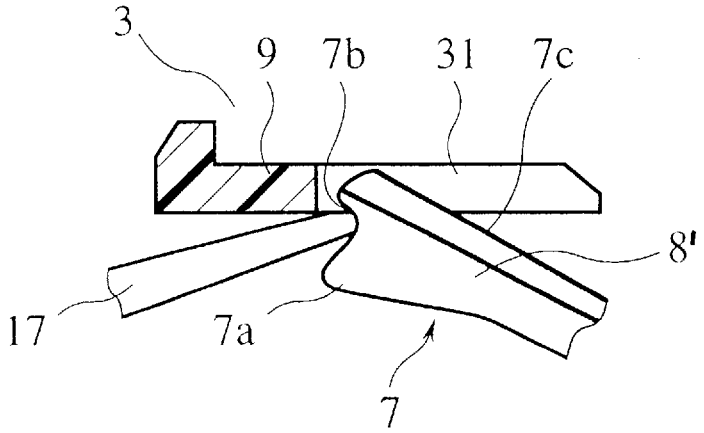
FIG. 4 is a partial side view of the connector housing of the present invention, showing a condition where a lance thereof is forcibly bent by a lance-removal tool.
Figure 5A:
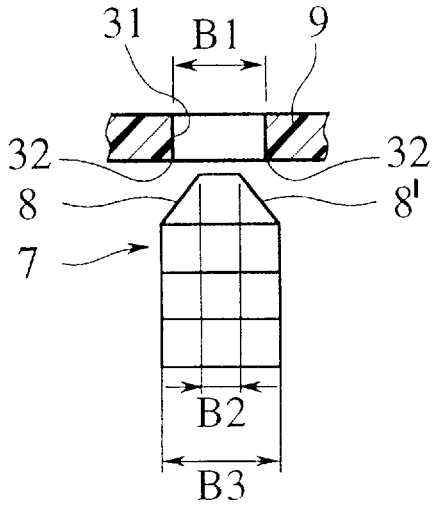
FIG. 5A is a front view of the connector housing of the present invention, showing a relationship in position between the lance and an orifice formed in an upper wall under the condition that the lance has not been bent forcibly yet.
Figure 5B:
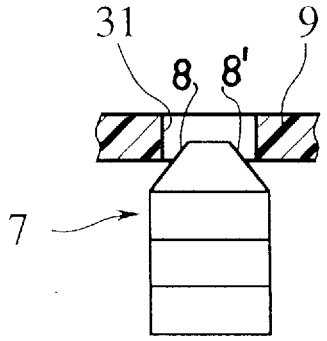
FIG. 5B is a view of the connector housing of FIG. 5A, showing a condition that the lance is bent forcibly and prevented from being deformed excessively.

On the other hand, in removing the terminals 5 from the connector housing 1, the terminal removing tool 17 is inserted from the front end of the connector housing 1 to an inside thereof so as to forcibly deform the lances 7 to the disengaging direction, as shown in FIG. 4. In the process of deforming the lances 7 by the terminal removing tool 17, the condition of each lance 7 is changed from a condition shown in FIG. 5A into a condition shown in FIG. 5B, so that the slanted surfaces 8, 83 of the lance 7 interfere with the edges of the cavity orifice 31, thereby preventing the lance 7 from being deformed excessively. Consequently, after pulling the terminal removing tool 17 from the connector housing 1, the lances 7 can return to their respective initial positions securely, thereby preparing for the forthcoming engagement with the terminals 5.

In this state, since the slanted surfaces 8, 8 on both sides of the lance 7 abut on the both edges of the cavity orifice 31, each lance 7 is not deformed in a forced posture. In addition, since the whole width B3 of the lance 7 is increased in comparison with the conventional lance, the engagement force with the terminals 5 can be increased.

Although the cavity orifice 31 in the wall 9 is adopted as the allowing means in the above mentioned embodiment, a simple recess may be applied instead of the cavity orifice 31 as a modification. Further, the slanted surfaces 8,8' as the stop means may be replaced with not-shown projections which are capable of interfering with the edges of the cavity orifice 31.

Finally, it will be understood by those skilled in the art that the foregoing description is one of preferred embodiments of the disclosed connector housing, and that various changes and modifications may be made to the present invention without departing from the spirit and scope thereof.

What is claimed is:

1. A connector housing for accommodating terminals therein, said connector housing comprising:

a housing body having a plurality of cavities formed adjacent to each other for accommodating said terminals therein a plurality of flexible lances, one for each of said cavities, arranged in said housing body, each of said flexible lances being engageable with a respective one of said terminals, thereby to fix said respective one of said terminals in position;

means for allowing said lances to be displaced in a disengagement direction with respect to said terminals, said allowing means being formed in walls defining said cavities; and stop means for stopping an excessive displacement of each of said lances, said stop means being disposed on each of said lances so as to interfere with said allowing means and to restrict the excessive displacement of said each of said lances in the disengagement direction by interfering with said allowing means;

wherein said allowing means comprises cavity orifices, each said cavity orifice penetrating a respective one of said walls defining said cavities, each said wall being arranged opposite a respective one of said lances;

wherein said stop means comprises slanted surfaces formed slanted relative to an upper surface of each of said lances, said upper surface facing each of said cavity orifices.

2. A connector housing as claimed in claim 1, wherein each of said lances is shaped so that a maximum width thereof is larger than a width of each of said cavity orifices, and a width of said upper surface of each of said lances is smaller than the width of each of said cavity orifices.

3. A connector housing as claimed in claim 2, wherein each of said lances is provided at a free end thereof with an engagement projection which is to be engaged with each of said terminals and with a concave portion for engagement with a terminal removing tool.

4. A connector housing for accommodating terminals therein, said connector housing comprising:

a housing body having a plurality of cavities formed adjacent to each other for accommodating said terminals therein;

a plurality of flexible lances, one for each of said cavities, arranged in said housing body, each of said flexible lances being engageable with a respective one of said terminals, thereby to fix said respective one of said terminals in position;

means for allowing said lances to be displaced in a disengagement direction with respect to said terminals, said allowing means being formed in walls defining said cavities; and stop means for stopping an excessive displacement of each of said lances, said stop means being disposed on each of said lances so as to interfere with said allowing means and to restrict the excessive displacement of said each of said lances in the disengagement direction by interfering with said allowing means;

wherein said allowing means comprises recesses, each said recess being formed on a respective one of said walls defining said cavities, each said wall being arranged opposite a respective one of said lances;

wherein said stop means comprises slanted surfaces formed slanted relative to an upper surface of each of said lances, said upper surface facing each of said resesses.

5. A connector housing as claimed in claim 4, wherein each of said lances is shaped so that a maximum of width thereof is larger than a width of each of said cavity orifices, and a width of said upper surface of each of said lances is smaller than the width of each of said cavity orifices.

6. A connector housing as claimed in claim 5, wherein each of said lances is provided at a free end thereof with an engagement projection which is to be engaged with each of said terminals and with a concave portion for engagement with a terminal removing tool.

7. A connector housing for accommodating terminals therein, said connector housing comprising:

a housing body having a plurality of cavities formed adjacent to each other for accommodating said terminals therein:

a plurality of flexible lances, one for each of said cavities, arranged in said housing body, each of said flexible lances being engageable with a respective one of said terminals, thereby to fix said respective one of said terminals in position;

means for allowing said lances to be displaced in a disengagement direction with respect to said terminals, said allowing means being formed in walls defining said cavities; and stop means for stopping an excessive displacement of each of said lances, said stop means being disposed on each of said lances so as to interfere with said allowing means and to restrict the excessive displacement of said each of said lances in the disengagement direction by interfering with said allowing means;

wherein said allowing means comprises cavity orifices, each said cavity orifice penetrating a respective one of said walls defining said cavities, each said wall being arranged opposite a respective one of said lances;

wherein said stop means comprises projections formed in the vicinity of an upper surface of each of said lances, said upper surface facing each of said cavity orifices.

8. A connector housing as claimed in claim 7, wherein each said lances is shaped so that a maximum of width thereof is larger than a width of each of said cavity orifices, and a width of said upper surface of each of said lances is smaller than the width of each of said cavity orifices.

9. A connector housing as claimed in claim 8, wherein each of said lances is provided at a free end thereof with an engagement projection which is to be engaged with each of said terminals and with a concave portion for engagement with a terminal removing tool.

10. A connector housing for accommodating terminals therein, said connector housing comprising:

a housing body having a plurality of cavities formed adjacent to each other for accommodating said terminals therein;

a plurality of flexible lances, one for each of said cavities, arranged in said housing body, each of said flexible lances being engageable with a respective one of said terminals, thereby to fix said respective one of said terminals in position;

means for allowing said lances to be displaced in a disengagement direction with respect to said terminals, said allowing means being formed in walls defining said cavities; and stop means for stopping an excessive displacement of each of said lances, said stop means being disposed on each of said lances so as to interfere with said allowing means and to restrict the excessive displacement of said each of said lances in the disengagement direction by interfering with said allowing means;

wherein said allowing means comprises recesses, each said recess being formed on a respective one of said walls defining said cavities, each said wall being arranged opposite a respective one of said lances;

wherein said stop means comprises projections formed in the vicinity of an upper surface of each of said lances, said upper surface facing each of said cavity recesses.

11. A connector housing as claimed in claim 13, wherein each said lances is shaped so that a maximum of width thereof is larger than a width of each of said cavity orifices, and a width of said upper surface of each of said lances is smaller than the width of each of said cavity orifices.

12. A connector housing as claimed in claim 11, wherein each of said lances is provided at a free end thereof with an engagement projection which is to be engaged with each of said terminals and with a concave portion for engagement with a terminal removing tool.

13. A connector housing for accommodating terminals therein, said connector housing comprising:

a housing body having a plurality of cavities formed adjacent to each other for accommodating said terminals therein;

a plurality of flexible lances, one for each of said cavities, arranged in said housing body, each of said flexible lances being engageable with a respective one of said terminals, thereby to fix said respective one of said terminals in position, each of said flexible lances having a tip portion;

means for allowing said lances to be displaced in a disengagement direction with respect to said terminals, said allowing means formed in walls defining said cavities; and stop means for stopping an excessive displacement of each of said lances, said stop means being disposed on each said tip portion of said each of said lances so as to interfere with said allowing means and to restrict the excessive displacement of said each of said lances in the disengagement direction by interfering with said allowing means.

14. A connector housing as claimed in claim 13, wherein said allowing means comprises cavity orifices, each said cavity orifice penetrating a respective one of said walls defining said cavities, each said wall being arranged opposite a respective one of said lances.

15. A connector housing as claimed in claim 13, wherein said allowing means comprises recesses, each said recess being formed on a respective one of said walls defining said cavities, each said wall being arranged opposite a respective one of said lances.

* * * * *

UNITED STATES PATENT AND TRADEMARK OFFICE

CERTIFICATE OF CORRECTION

PATENT NO. : 5,769,663
DATED : June 23, 1998
INVENTOR(S) : Shinji Kodama

It is certified that error appears in the above-identified patent and that said Letters Patent is hereby corrected as shown below:

Col. 1, line 62, after "terminals" insert --,--.
Col. 1, line 65, change "terminals;" to --terminals,--.
Col. 3, line 26, change "herenafter" to --hereinafter--.
Col. 3, line 31, after "referred" insert --to--.
Col. 3, line 49, change "8,83" to --8,8'--.
Col. 3, line 56, change "8,83" to --8,8'--.
Col. 4, line 4, change "by" to --with--.
Col. 4, line 7, change "8,83" to --8,8'--.
Col. 4, line 14, change "8,8" to --8.8'--.

Col. 5, (Claim 4), line 37, change "resesses" to --recesses--.
Col. 6, (Claim 10), line 50, after "said" (2nd occurrence) delete "cavity".
Col. 6, (Claim 11), line 51, change "13" to --10--.

Signed and Sealed this

Ninth Day of March, 1999

*Attest:*

Q. TODD DICKINSON

*Attesting Officer*

*Acting Commissioner of Patents and Trademarks*